US005511855A

United States Patent [19]

Miles

[11] Patent Number: 5,511,855

[45] Date of Patent: Apr. 30, 1996

[54] FOLD-OUT, HEIGHT ADJUSTABLE CHAIR AND SUPPORT STRUCTURE FOR SAME

[76] Inventor: Robert A. Miles, 68 Klaum Ave., North Tonawanda, N.Y. 14120

[21] Appl. No.: 192,593

[22] Filed: Feb. 7, 1994

[51] Int. Cl.[6] ..... A47C 7/00

[52] U.S. Cl. ..... 297/447.2; 297/338

[58] Field of Search ..... 297/19, 21–25, 297/55, 57, 311, 337, 338, 445–447, 449; 182/102; 248/168

[56] References Cited

U.S. PATENT DOCUMENTS

| | | | |
|---|---|---|---|
| 2,267,963 | 12/1941 | White et al. | 297/23 |
| 4,148,523 | 4/1979 | Brand et al. | 297/338 X |
| 4,793,654 | 12/1988 | Takafuji | 297/23 X |

*Primary Examiner*—Milton Nelson, Jr.
*Attorney, Agent, or Firm*—Wallace F. Neyerlin

[57] ABSTRACT

The chair has a support structure with a wide stable base. The chair has a single inverted U-shaped tubular metal main frame. Near the top and inside of the frame is connected a tubular metal back leg unit set of two legs to swing out away from the inverted U-shaped frame. The support structure is also characterized by possessing:

a. A pair of horizontal metal cross-bars affixed within the tubular metal main frame, one near the top and the other near the bottom; and b. A pair of metal tubes attached to and between the cross-bars and situated substantially in the same plane as the main frame.

The back leg unit is pivotally connected to the main frame near the top thereof, the legs of the back unit being angled away from vertical near the top of the unit, and said back unit also possessing a pair of metal horizontal crossbars, one of said bars being located slightly below the angular bends in the legs of the back unit and the other bar being located near the bottom of the back unit, and the base of the legs of the back unit being bent substantially at right angles outwardly from the legs.

7 Claims, 5 Drawing Sheets

7
2
31
5
39
36
11
38
38'
100
101
4'
37
37'

Fig. 6
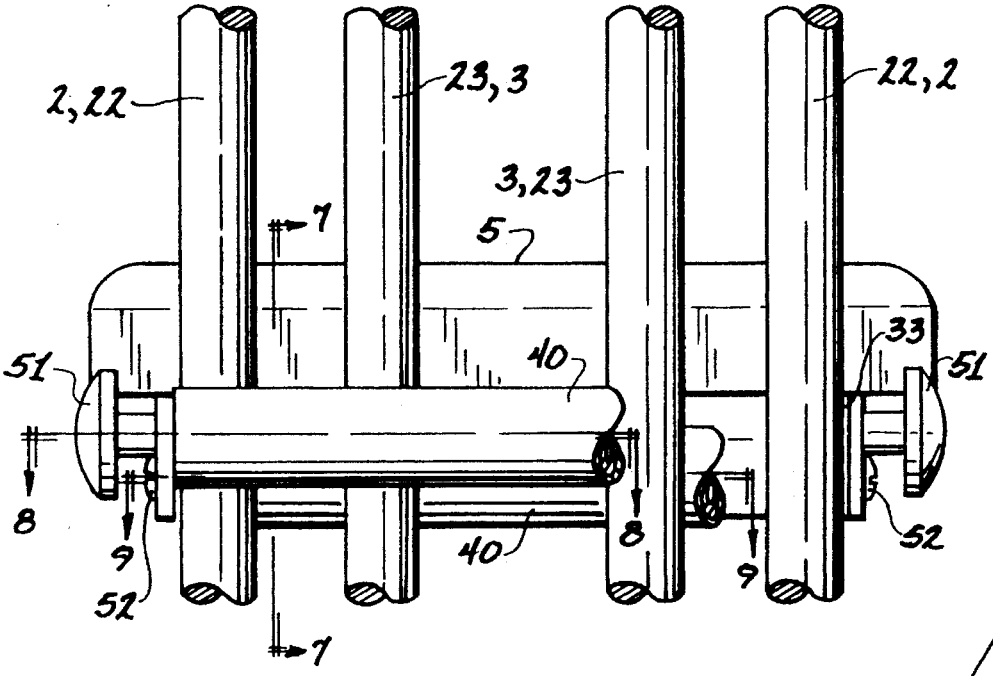
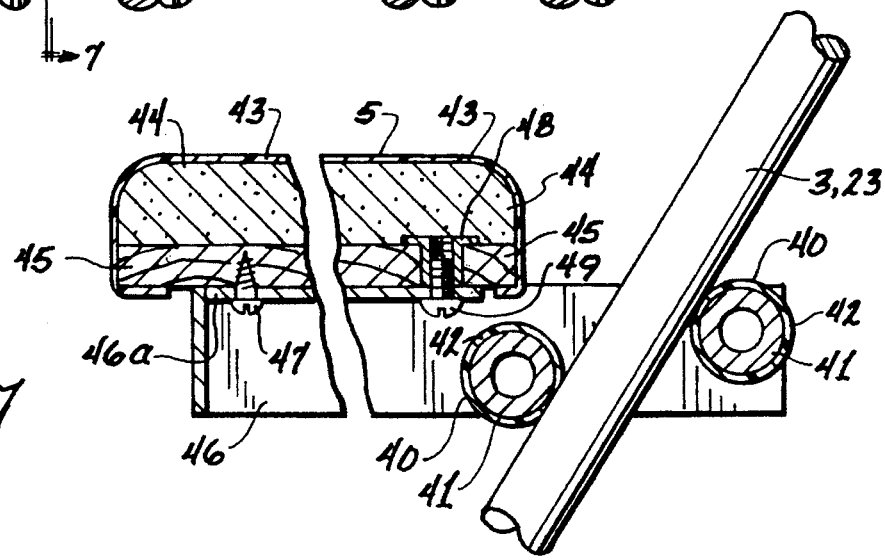
Fig. 7
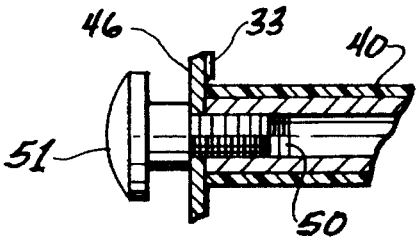
Fig. 8
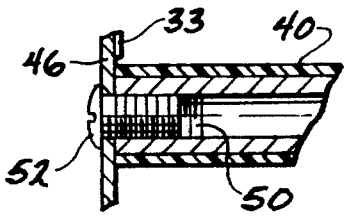
Fig. 9

FOLD-OUT, HEIGHT ADJUSTABLE CHAIR AND SUPPORT STRUCTURE FOR SAME

BACKGROUND OF THE INVENTION

This invention relates to a fold-out, height adjustable chair which is believed to possess several unique and advantageous features as compared to any such other fold-out, height adjustable chair known to applicant. A unique support structure makes possible the advantages that the chair possesses over other height adjustable chairs.

DESCRIPTION OF PRIOR ART

A search was carried out by the applicant for any patents describing chairs having fold out height adjustable features. U.S. Pat. No. 4,793,654, issued to H. Takafuji, was the only one found by applicant in connection with this search. A file history of this patent was ordered by applicant, as were also copies of the references cited in same. Neither the U.S. Pat. No. 4,793,654 patent nor any of the references cited in same are believed to have the specific advantageous features of the chair of the present invention, or to teach or suggest such features.

SUMMARY OF THE INVENTION

The chair of the present invention has a support structure with a wide stable base and with an extensive height adjustable capability, typically from as low a height as 9 inches to a height of 32 inches or higher. The chair has a single inverted U-shaped tubular metal main frame. A tubular metal back leg unit set of two legs is connected to the main frame near its top and inside of the frame. This arrangement enables the back leg unit to be swung out away from the inverted U-shaped frame for stability.

The support structure also is characterized by possessing:

a. A pair of horizontal metal cross-bars affixed within the tubular metal main frame, one near the top of same and the other near the bottom of same;

b. A pair of metal tubes attached to and between the cross-bars and situated substantially in the same plane as the main frame; and c. The aforesaid tubular metal double legged back unit; this unit is pivotally connected to the main frame unit near the top thereof, the legs of said back unit being angled away from vertical near the top of said unit, and said back unit also possessing a pair of metal horizontal cross-bars, one of said bars being located slightly below the angular bends in the legs of the back unit and the other bar being located near the bottom of the back unit, and the base of the legs of the back unit being bent substantially at right angles outwardly from the legs.

No other fold-out height adjustable chairs known to applicant are believed to possess any support structure with the elements as just described.

Besides the above-described elements, the height adjustable chairs of the present invention also possess additional structural elements considered to be unique with the present invention, including:

a. a locking metal bar means affixed to each of the lower horizontal cross-bars of the main frame and of the double legged back unit, said bar means functioning to limit any change in distance between the main frame and the double legged back unit when the bar means is in its maximum length position. In a preferred embodiment this metal bar means is collapsible near its mid-point as described with reference to the drawings. In another embodiment it is of a single bar which pivots from the lower horizontal cross-bar of the back leg unit to the lower horizontal cross-bar of the main frame in the chair as-used position; or optionally to the upper horizontal cross-bar of the back leg unit for fold-out or storage purposes.

b. dual cylindrical supports means extending across the front and the rear of the inverted U-shaped main frame capable of providing height adjustment of the seat for the chair; and c. structural support means for supporting a seat for said chair, said structural support means being mechanically linked to the dual cylindrical support means.

Besides its unique support structure, the height adjustable chair of the present invention possesses several additional elements and/or advantageous features which will be described and more clearly explained by reference to the drawings.

The front of the chair is set at an angle of about 32 degrees from vertical, and its seat is preferably padded. The dual cylindrical support means are located below and also to the rear of the seat, and these allow for the positioning of the seat to be firm and non-slipping when set at the height desired by the user. As previously stated, the support structure preferably also possesses a collapsible locking bar near its base, connected to cross-bars located between the front U-shaped section of the chair and also between the rear legs of the chair. This locking bar prevents the chair from closing or spreading open further than the user of the chair desires when sitting on same. By collapsible is meant that the bar folds or pivots near its mid-point so that the rear legs can be brought closely toward the front inverted U-shaped main frame when the chair is not in use.

The design of the chair provides comfort to its user and a secure feeling knowing that the adjustable seat will not fall or slide. The chair is lightweight and easily portable when not in use and provides safety and ease of mind when being used. It is believed that several groups of people would find the chair very useful in their activities, including artists, musicians, photographers, astronomers and office personnel who enjoy being able to adjust their seat height personally to their individual comfort.

BRIEF DESCRIPTION OF THE DRAWINGS

FIG. 6 is a rear view of the seat area of the chair of FIG. 2.

FIG. 7 is a section view of the seat area taken across cut-line 7—7 of FIG. 6.

FIG. 8 is a section view taken across cut line 8—8 of FIG. 6.

FIG. 9 is a section view taken across cut line 9—9 of FIG. 6.

The drawings are now referred to and described in more detail.

DETAILED DESCRIPTION OF THE DRAWINGS AND OF THE PREFERRED EMBODIMENTS

Figure 1:
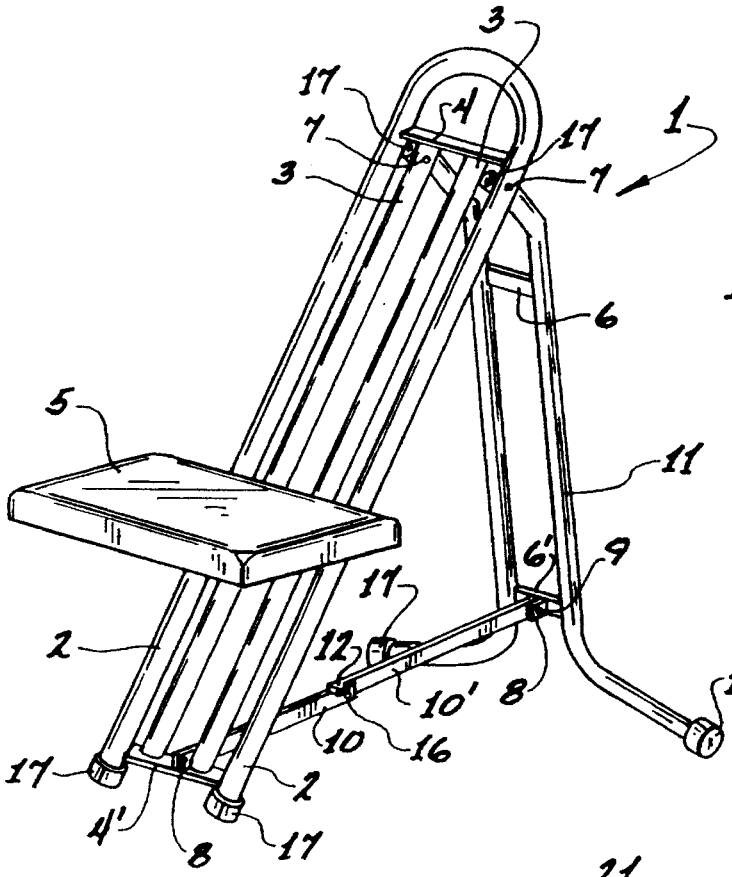
FIG. 1 is a perspective view of a low chair of this invention.
Figure 3:
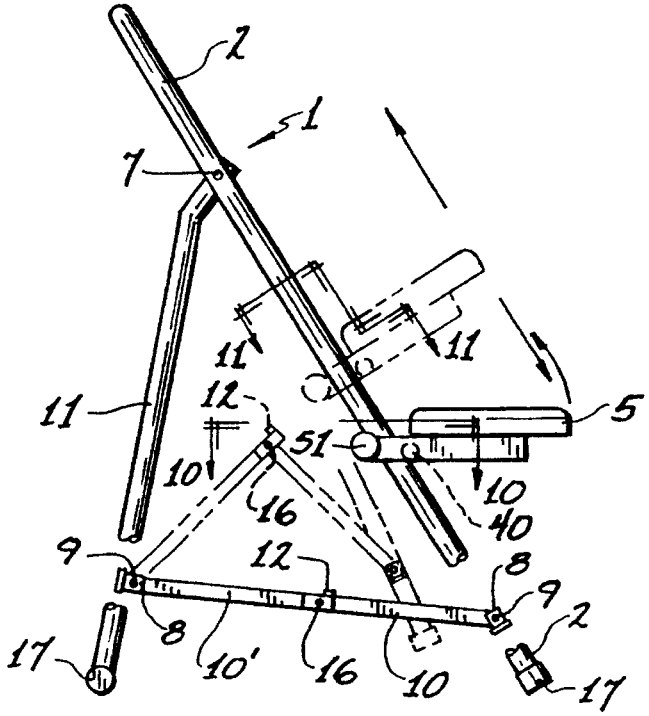
FIG. 3 is a side view of the chair of FIG. 1.

Referring now to the "low" chair of FIGS. 1 and 3, numeral 1 refers to the entire low chair; numeral 2 refers to the front leg unit or the inverted U-shaped main frame; numeral 3 refers to front inside tubing; numeral 4 refers to a crossbar near the top of the chair, which bar is affixed (preferably by welding) between the front leg unit near its semi-circular arched top, and to which bar 4, the front inside tubing 3 is attached (preferably also by welding) as shown in FIG. 1; numeral 4' is like bar 4 between the legs of the front leg unit but near its base; (and also preferably attached thereto by welding), numerals 6 and 6' are cross-bars between the legs of the back leg unit 11 near the top and bottom respectively, and attached in a manner like cross-bars 4 and 4'; these bars provide desired rigidity to the unit when in use and also when in storage; numeral 5 depicts the seat; numerals 10 and 10' depict the collapsible bar for locking the chair out in its "as-used" position; numeral 11 depicts the dual back legged unit of the chair; numeral 7 depicts hinge pins or threaded bolts for connecting the front leg unit 2 to the back leg unit 11 so that the back leg unit can be pivoted away from the front leg unit to adapt the chair to its "as-used" position illustrated in FIG. 1; numeral 8 depicts mounting tabs welded to the cross-bars 4' and 6' to which tabs the collapsible bars 10 and 10' are connected by means of threaded pins or bolts 9; numeral 12 depicts a locking tab to lock the bars 10 and 10' to their "lock-out" position between the front leg unit and the back leg assembly near the base of the chair. Numeral 16 is a pivot pin enabling the chair to be folded out or folded in (FIG. 3) and numeral 17 depicts plastic end caps utilized at the various positions indicated in FIG. 1 in completing the final structure of the chair. In FIG. 3, numeral 40 depicts a gripping tube and numeral 51 depicts a threaded knob. More is said regarding these elements later on in describing FIGS. 6 to 9.

Figure 2:
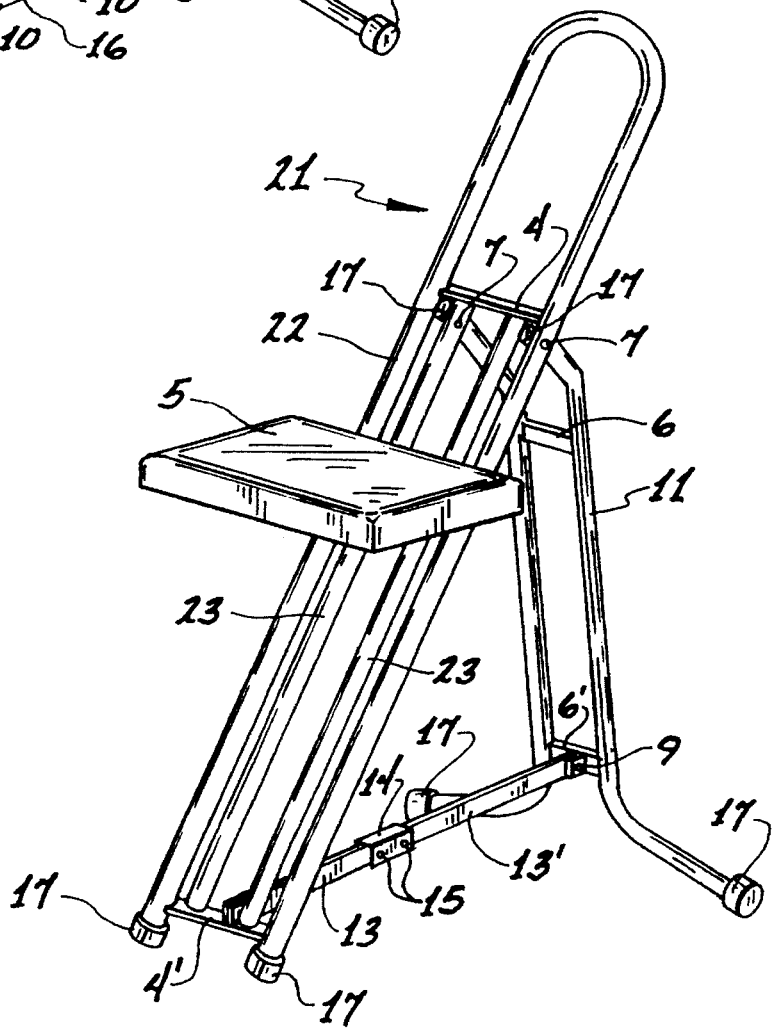
FIG. 2 is a perspective view of a high chair of this invention.
Figure 4:
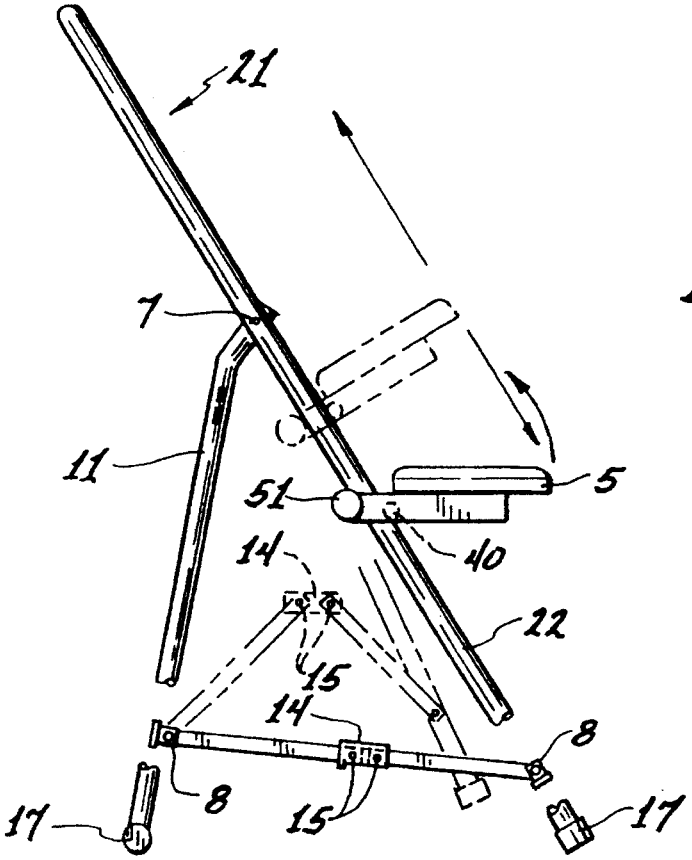
FIG. 4 is a side view of the chair of FIG. 2.

Referring now to the "high" chair of FIGS. 2 and 4, numerals 4, 4', 5, 6, 6', 7, 9, 11, 17, 40 and 51 refer to the corresponding components of the low chair of FIGS. 1 and 3; numeral 21 refers to the entire high chair, numeral 22 refers to its front leg unit or inverted U-shaped main frame; numeral 23 refers to the front inside tubing; numerals 13 and 13' depict the collapsible bar for locking the chair out in its "as-used" position. For storage purposes, because of the increased size of the chair, it is desirable that the bars 13 and 13' be hinged near mid-point as illustrated in FIGS. 2 and 4. Numeral 14 in said Figures illustrates a saddle or pivot joint for the bars. FIG. 4 illustrates the joint in its flexed (or locked) position and FIG. 2 illustrates the joint in its locked position. Numeral 15 depicts pins or bolts for passing through holes in the saddle 14 and the bars 13 and 13' to assure rigidity and safety of the chair when in its "as-used" condition.

Figures 5, 5A:
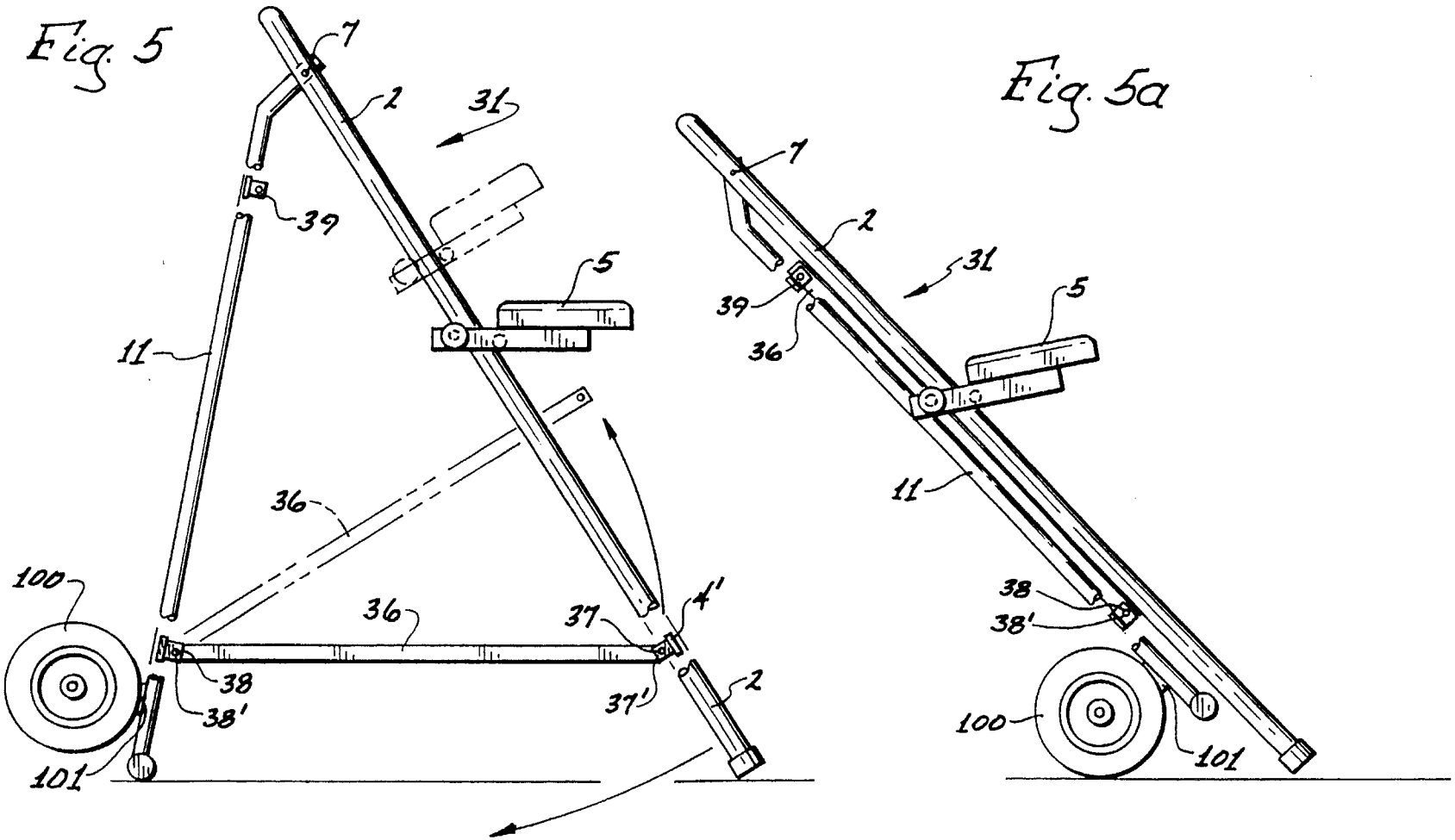
FIG. 5 is a side view of a chair of optional construction with regard to the "locking bar." This figure also illustrates a modification of adding a set of wheels to the legs of the back leg unit for portability ease if desired by the chair user.
FIG. 5*a* illustrates the folded version of the chair of FIG. 5.

As to FIG. 5 this illustrates a chair of optional construction with regard to the construction and positioning of the locking bar which can be resorted to, to facilitate a way of dismantling the chair for storage and/or shipment. In this figure, numeral 36 depicts a non-collapsible locking bar, numeral 37' a bracket for 36 on cross-bar 4' for adjusting the chair to its "as-used" position and numeral 38' is a bracket on the horizontal cross-bar of the back leg unit 11 for holding bar 36 in position; bracket 37' has a pin 37 therethrough and bracket 38' also has a pin 38 therethrough about which pin bar 36 can be pivoted into bracket 39 for folding the chair up into its unused position. When this is done, the seat 5 and its supporting elements can also be lowered to the bottom of front leg unit 2 and removed for storage or shipment.

As previously stated, the rear legs of the chairs of this invention can sometimes be modified for portability purposes by adding wheels 100 to the legs, rotatably attached thereto by means of brackets 101. In the chair "as-used" position, the wheels do not touch the surface of the floor in which the chair is used (FIG. 5); but when folded up and tilted (FIG. 5*a*) the wheels, but not the legs of the chair, contact the floor's surface.

FIGS. 6, 7, 8 and 9 illustrate the tie-in relationship of the seat and the gripping mechanism for same with the structural support components of the chair. In FIGS. 6, 7, 8 and 9, numerals 2, 3, 5, 22, 23, 40 and 51 refer to components of the chair previously described. Numeral 33 in FIGS. 6, 8 and 9 designates an optionally preferred felt pad between a supporting bracket 46 for the seat and the ends of the cylindrical gripping roller 40 which roller is in front of the tubes 2 and 3 in the chair of FIG. 1 or in front of the tubes 22 and 23 in the chair of FIG. 2. Gripping cylindrical rollers 40 are also behind the tubes 2 and 3 in the chair of FIG. 1 or the tubes of 22 and 23 of the chair of FIG. 2, as illustrated in FIGS. 6 and 7. Gripping rollers 40 are preferably steel tubes 42 coated with plastic 41, such as vinyl for frictional and sound-proofing purposes of engagement with the tubes that they straddle.

When one using the chair wishes to adjust the height of the seat all he needs to do is exert an upward lifting force under the seat 5 and slide the seat up or down as desired. The gripping rollers or tubes slide along the front tubes to the height desired, after which the lifting force is released and the seat becomes horizontal and can no longer move up or down because of being locked in place by the horizontal gripping tubes which extend across the entire width of the inverted U-shaped main frame. This locking action is even more increased when augmented by the weight of the user of the chair sitting on the seat. (The right side ends of the gripping tubes of FIG. 6 are shown broken off merely for purposes of illustration.)

Figure 10:
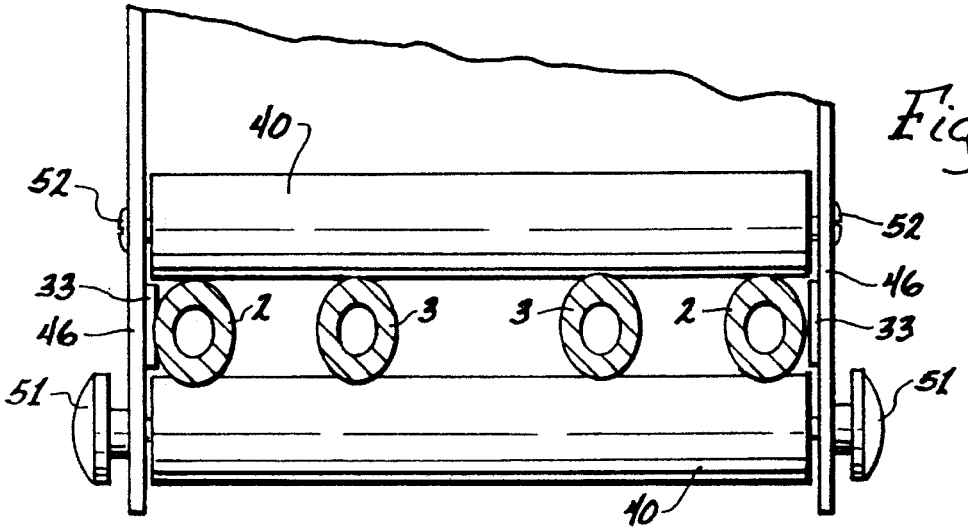
FIG. 10 is a section view taken across cut line 10—10 of FIG. 3 where the seat is in its "as-used" position.

In FIG. 10, the chair is in its "as-used" position. In this position, the front and rear gripping tubes 40 both abut tightly against the tubes 2 and 3 of the front section of the chair. (Because the gripping tubes are surrounded by a plastic material for reasons previously stated, the tubes 2 and 3 press slightly into and beyond their surfaces as shown in FIG. 10 particularly when a person sits upon the chair.) To change the height of the seat the user simply raises the seat which releases the engagement of the gripping tubes from tubes 2 and 3, as shown in FIG. 11; or sometimes tilts the seat slightly to change the height of the seat, as depicted in FIG. 12.

Referring to FIG. 7, the underside of the seat is supported by a U-shaped metal seat bracket 46 with a flat planar surface 46*a* of about one-half the surface area of the underside of the seat. Numeral 43 depicts the seat cover (such as leather or vinyl), numeral 44 depicts foam padding, numeral 45 depicts a plywood base under the entire seat, number 47 depicts a wood screw going through the metal planar surface 46*a* and screwed tightly into the plywood 45. The fastening can also be accomplished by bolts 49 ending in T-inserts 48. The gripping tube assemblies are preferably steel tubes 42 about one foot long with vinyl covers 41 which contribute to soundless, frictionally increased engagement in making the desired height adjustment.

Figure 11:
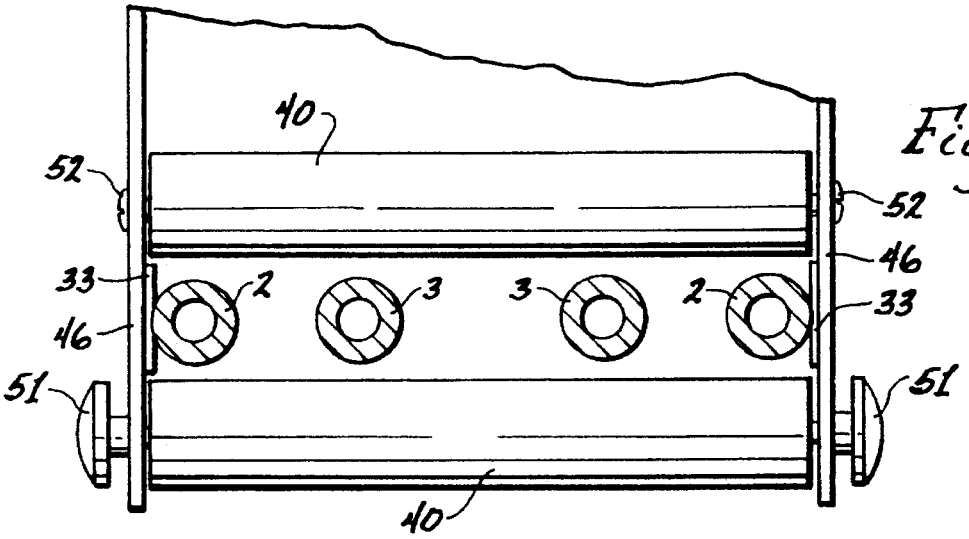
FIG. 11 is a section view taken across cut line 11—11 of FIG. 3 showing a variation in the seat support structure when the seat is raised from horizontal.
Figure 12:
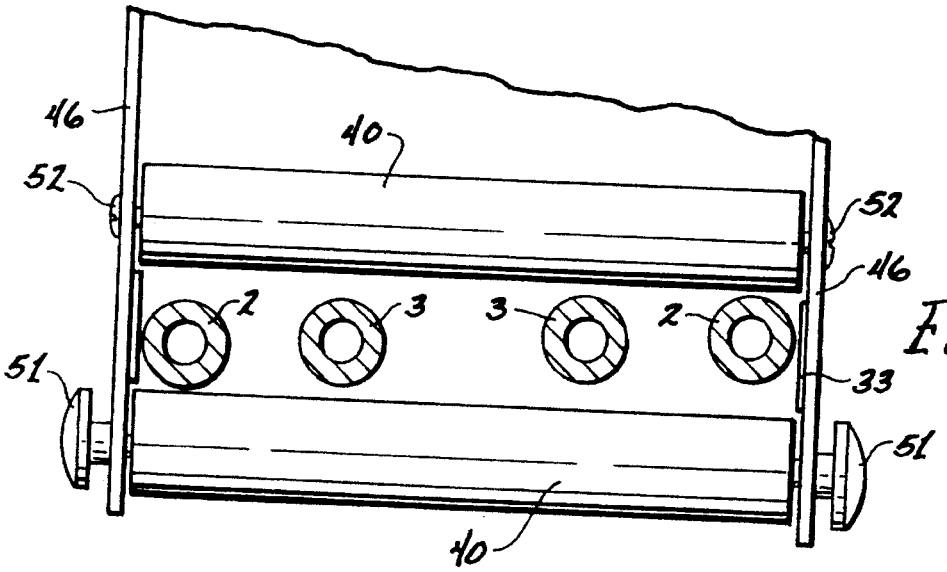
FIG. 12 is a variation of FIG. 11 wherein the seat is both raised and twisted from horizontal and its relation to the support structure under same.

As shown in FIGS. 8 and 9, and also in FIGS. 10, 11 and 12, the gripping tubes 40 possess internal threads 50 at each of their ends, with the rear tubes having threaded knobs 51 and the front tubes having threaded bolts 52. These tubes 40 may thusly be easily disconnected from the metal support frame 46 under the seat for further ease of storage or for minimizing space requirements for transportation and shipping. The tubing employed in constructing the chair is heavy wall thickness steel and the entire chair weighs about 18 pounds. The tubing is coated with an environmentally safe powder as opposed to a solvent based paint or an enamel. The coating does not flake with heat treatment and the tubing is bent to the correct desired angles either after or before the coating has been applied.

Having thus described the invention, it should be apparent that numerous structural modifications and adaptations may be resorted to without departing from the scope and fair meaning of the instant application as described here above and claimed below.

What is claimed is:

1. A support structure for a fold-out, height adjustable chair comprising:

(a) an inverted U-shaped tubular metal main frame;

(b) a pair of horizontal metal cross-bars affixed within the tubular metal main frame, one near the top of same and the other near the bottom of same;

(c) a pair of metal tubes attached to and between the cross-bars and situated substantially in the same plane as the main frame; and (d) a tubular metal double legged back unit pivotally connected to the main frame near the top thereof, the legs of said back unit having angular bends angling away from vertical near the top of said back unit, and said back unit also possessing a pair of metal horizontal cross-bars, the first of said pair of cross-bars being located slightly below the angular bends in the legs of the back unit and the second of said pair of cross-bars being located near the bottom of the back unit, and the legs of the back unit being bent substantially at right angles outwardly at the bottom of the back unit.

2. A support structure according to claim 1 wherein the legs of the tubular metal double legged back unit of (d) of claim 1 have wheels rotatably attached thereto at their base.

3. A support structure for a fold-out, height adjustable chair comprising:

(a) an inverted U-shaped tubular metal main frame;

(b) a pair of horizontal metal cross-bars affixed within the tubular metal main frame, one near the top of same and the other near the bottom of same;

(c) a pair of metal tubes attached to and between the cross-bars and situated substantially in the same plane as the main frame;

(d) a tubular metal double legged back unit pivotally connected to the main frame near the top thereof, the legs of said back unit having angular bends angling away from vertical near the top of said back unit, and said back unit also possessing a pair of horizontal metal cross-bars, the first of said pair of cross-bars being located slightly below the angular bends in the legs of the back unit and the second of said pair of cross-bars being located near the bottom of the back unit, and the legs of the back unit being bent substantially at right angles outwardly at the bottom of the back unit;

(e) locking metal bar means affixed to each of the lower horizontal cross-bars of the main frame and of the double legged back unit, said bar means functioning to limit any change in distance between the main frame and the double legged back unit when the bar means is in its maximum length position;

(f) dual cylindrical support means extending across the front and the rear of the inverted U-shaped main frame capable of providing height adjustment of a seat for the chair; and (g) structural support means for supporting a seat for the chair, said structural support means being mechanically linked to the dual cylindrical support means.

4. A support structure according to claim 3 wherein the locking metal bar means of (e) of claim 3 is collapsible near its lengthwise mid-point.

5. A fold-out, height adjustable chair comprising:

(a) an inverted U-shaped tubular metal main frame;

(b) a pair of horizontal metal cross-bars affixed within the tubular metal main frame, one near the top of same and the other near the bottom of same;

(c) a pair of metal tubes attached to and between the cross-bars and situated substantially in the same plane as the main frame;

(d) a tubular metal double legged back unit pivotally connected to the main frame near the top thereof, the legs of said back unit having angular bends angling away from vertical near the top of said back unit, and said back unit also possessing a pair of horizontal metal cross-bars, the first of said pair of cross-bars being located slightly below the angular bends in the legs of the back unit and the second of said pair of cross-bars being located near the bottom of the back unit, and the legs of the back unit being bent substantially at right angles outwardly at the bottom of the back unit;

(e) locking metal bar means affixed to each of the lower horizontal cross-bars of the main frame and of the double legged back unit, said bar means functioning to limit any change in distance between the main frame and the double legged back unit when the bar means is in its maximum length position;

(f) dual cylindrical support means extending across the front and the rear of the inverted U-shaped main frame capable of providing height adjustment of a seat for the chair;

(g) structural support means for supporting a seat for the chair, said structural support means being mechanically linked to the dual cylindrical support means; and (h) a seat for the chair, said seat comprising a plywood base atop and affixed to the structural support means of (g) above and said seat also comprising a seat cover and foam padding.

6. A fold-out, height adjustable chair according to claim 5 wherein the locking metal bar means of (e) of claim 5 is collapsible near its lengthwise mid-point.

7. A fold-out height adjustable chair according to claim 5 wherein the legs of the tubular metal double legged back unit of (d) of claim 5 have wheels rotatably attached thereto at their base.

* * * * *